US005452993A

United States Patent [19]

Lanigan

[11] Patent Number: 5,452,993

[45] Date of Patent: Sep. 26, 1995

[54] STERILIZE-IN-PLACE DIAPHRAGM PUMPS

[75] Inventor: Don Lanigan, Ellicott City, Md.

[73] Assignee: National Instrument Co., Inc., Baltimore, Md.

[21] Appl. No.: 283,621

[22] Filed: Aug. 1, 1994

[51] Int. Cl.[6] ..... F04B 43/02

[52] U.S. Cl. ..... 417/413.1

[58] Field of Search ..... 417/395, 383, 417/384, 385, 386, 387, 388, 413.1, 360; 92/87

[56] References Cited

U.S. PATENT DOCUMENTS

| | | | |
|---|---|---|---|
| 3,250,225 | 5/1966 | Taplin | 417/413.1 |
| 3,769,879 | 11/1973 | Lofquist, Jr. | 417/386 |
| 3,855,995 | 12/1974 | Bentley | 417/383 |
| 4,035,107 | 7/1977 | Kesten et al. | 417/413.1 |
| 4,265,600 | 5/1981 | Mandroian | 417/395 |
| 4,269,906 | 5/1981 | Schmechtig | 417/383 |
| 4,466,339 | 8/1984 | Muddle | 417/395 |
| 4,846,636 | 7/1989 | Danby et al. | 417/413.1 |
| 5,145,331 | 9/1992 | Goes et al. | 417/383 |
| 5,192,198 | 3/1993 | Gebaver et al. | 417/383 |
| 5,306,122 | 4/1994 | Gebaver et al. | 417/383 |

*Primary Examiner*—Richard A. Bertsch
*Assistant Examiner*—Peter G. Korytnyk
*Attorney, Agent, or Firm*—Barnes & Thornburg

[57] ABSTRACT

A pump housing including a base and head mounted to the base in a working position and a sterilize-in-place position. A flexible rolling diaphragm is positioned and clamped by the base and head in the working position to define between the diaphragm and head a working chamber. A retainer is provided for retaining the diaphragm fixed to the base when the base and head are in their sterilize-in-place position. The housing elements in their working position, exposes a first area of the diaphragm to the working chamber and in the sterilize-in-place position, exposes a second area greater than and including the first area. This provides a larger area of sterilization beyond the clamping area which is exposed in the working position of the head and base.

16 Claims, 4 Drawing Sheets

STERILIZE-IN-PLACE DIAPHRAGM PUMPS

BACKGROUND AND SUMMARY OF THE INVENTION the present invention relates generally to the cleaning of filling machines or pumps and more specifically to sterilizing-in-place rolling diaphragm filling units utilized on filling machines.

Filling machines in which one or more containers such as, bottles, ampules, etc. are individually or simultaneously filled by filling units from a respective nozzle to be lowered into the containers, or held above the containers are known in the art, for example, as described in U.S. Pat. No. 4,212,416 to Bennett. The filling units, sometimes referred to as pumps or metering units, have generally included a piston-cylinder arrangement wherein the piston rod is connected to a piston to both push and pull the piston during a reciprocal intake and discharge stroke of the filling unit.

The filling units or pumping units, generally include five major components, mainly a head, a piston, a cylinder, an inlet valve, and an outlet valve. The head has an internal chamber connecting the cylinder and inlet and outlet valves mounted at appropriate ports. Generally the head has been uniquely designed to receive specific pistons and cylinders, inlet valves and outlet valves. A more universal design is disclosed in U.S. Pat. No. 5,154,589 to Ruhl, et al. The inlet and outlet valves are shown as check valves, spool valves, and duck-bill valves. The piston includes a standard pump with a dynamic seal as well as a rolling diaphragm. A further example of a rolling diaphragm pump which allows controlling the amount of material dispensed through the stroke of the diaphragm is shown in U.S. Pat. No. 4,569,378 to Bergandy. All three of the above patents are incorporated herein by reference.

Whereas the Ruhl, et al. U.S. Pat. No. 5,154,589 is designed for ease of assembly, there is still a need to flush the filling unit when changing materials. The early rolling diaphragm pumps of the Bergandy U.S. Pat. No. 4,569,378 have the advantage of no frictional contact parts in the material flow path, minimal particulate generation and a high degree of accuracy. Although it has been designed with reusable parts, some users have cited an excessive number of working parts to assemble or disassemble the pump even for the reusable product contact parts. For the most part, these costs are related to disassembly, sterilization, and reassembly of the pumps at frequent intervals.

The conventional sterilization techniques for rolling diaphragm pumps require that the pump be completely disassembled, and the diaphragm and fluid chamber along with valving components are autoclaved, rendering all surfaces sterile. This is the only effective method to guarantee that the sterile integrity of the pump is not compromised by the flexing of the diaphragm during operation. Although many reciprocating piston pump systems utilizing rolling diaphragms are presented as Steam-In-Place or Sterilize-In-Place systems, it is not possible to create and maintain a sterile condition in these pumps that extends beyond the sterile boundary edge that is established during the sterilization process. Referring to FIG. 1, a lip 14 of a rolling diaphragm 12 is clamped between flanges surfaces 22 and 32 of the pump housing 10 to form a fluid working chamber as illustrated in FIG. 1.

The sterile boundary edge 16 formed on lip 14 from clamping edge 15, when the prior art Steam-In-Place sterilization regimen is utilized as an alternative to autoclaving, is illustrated in FIG. 2. The representation of sterile boundary edge as a definite line is a simplification for descriptive purposes. The actual boundary may appear as a nebulous zone as depicted in FIG. 2.

As the steam fills the chamber and sterilizes the internal surfaces, a sterile boundary edge is formed where the top surface of the diaphragm meets the surface of the flange of the pump housing. The shading represents the unsterilized area of the surface, and the unshaded portion represents the sterilized area. The irregularity of the sterile boundary edge is due to variables such as the surface roughness of the diaphragm, thickness variations in the diaphragm material, the clamping force, and slight dimensional variations in the flange surfaces. Each pump will establish a different sterile boundary edge pattern after sterilization-in-place. Once the extent of the sterile boundary edge has been established during the internal sterilization process, it cannot be extended without re-sterilization. But the encroachment of the non-sterile edge into the sterile area is possible and highly probable, once the pump begins to function.

In operation, the dynamic forces within the pump impact upon the internal surfaces. The intake valve is actuated to the open position as the piston and diaphragm are withdrawn, causing a negative pressure and drawing fluid into the pump. At the end of the intake stroke, the intake valve is closed, the discharge stroke begins, and fluid is forced out of the pump under positive pressure. Concurrently, the diaphragm is alternately convoluted and fully extended during each cycle causing stretching and flexing of the diaphragm material. The pulsating forces acting upon the diaphragm are resisted by the clamping force around its outer rim, causing tension in the diaphragm fiber.

During this cycling, the sterile boundary edge is displaced and the fluid in the pump is exposed to unsterilized surfaces at various locations along the edge. Thus, the sterile integrity of the pump cavity is compromised. It should be noted here that if the pumps were initially disassembled and autoclaved, the surfaces exposed to the fluid due to flexing of the diaphragm in its seat would be sterile surfaces, and sterility would be maintained in the pump cavity. Thus, internal or in-place sterilization, which relies on the establishment and maintenance of a tenuous and transient sterile edge, is not a viable technique.

Although autoclaving is most certainly an effective procedure for establishing sterility, it has several inherent drawbacks which impact negatively on production efficiency. Removal of components from the machine, disassembly to expose critical internal surfaces, autoclaving, sealing of sterile components in protective bags, reassembly of the components, and re-installation onto the machine are all tedious and time-consuming procedures which result in extended production down-time and elevated operating costs.

It should be noted that C.I.P. is known in the industry as clean-in-place and refers to a procedure which requires a circulation of a sanitizing fluid through the system which washes the system and flushes out particles and debris. Sterilization is not necessarily a result of this procedure. Industry defines S.I.P. as sterilizing-in-place and requires a circulation throughout this system of a sterilizing medium, generally in a gaseous or vaporous state and under pressure, which will penetrate the interior of the system and render it sterile. The present invention is directed specifically to a sterilization-in-place system and not a clean-in-place system.

Thus, it is an object of the present invention to provide a rolling diaphragm pump with a minimal number of parts which can be sterilized-in-place without complete disassembly.

Another object of the present invention is to provide a rolling diaphragm filling unit or pump which can be sterilized in-place.

A further object of the present invention is to provide a truly in-place sterilization of a rolling diaphragm pump.

A still further object of the present invention is to reduce the initial cost and ongoing maintenance expense of rolling diaphragm pumps in sterile filling applications as well as others of general purpose fluid metering.

These and other objects are achieved by a pump housing including a base and head mounted to the base in a working position and a sterilize-in-place position. A flexible rolling diaphragm is positioned and clamped by the base and head in the working position to define between the diaphragm and head a working chamber. A retainer is provided for retaining the diaphragm fixed to the babe when the base and head are in their sterilize-in-place position. The housing elements in their working position, exposes a first area of the diaphragm to the working chamber and in the sterilize-in-place position, exposes a second area greater than and including the first area. This provides a larger area of sterilization which would be beyond the clamping area, than that area exposed in the working position of the head and body. The head defines the first working area and the retainer determines the second larger sterilize-in-place area. A seal is provided between the base and head in both the working and sterilize-in-place positions.

The retainer is in a recess of a head facing the base. The retainer is exterior to the working chamber in the working position of the head and base and is partially exposed to the working chamber in the sterilize-in-place position of the head and base. The retainer may include a ring and a spring for biasing the ring towards the base so as to retain the diaphragm on the base when the head and base are in the sterilize-in-place position. Interconnecting elements connect the head and base for defining the working and the sterilize-in-place positions thereof. These interconnecting elements include a peripheral recess in the head and a pin in the base extending into the peripheral recess for defining at least the sterilize-in-place position. These interconnecting elements also include a clamp for clamping the head and base together in and defining the working position. The pin is removable to allow disassembly of the housing elements.

A method for sterilizing-in-place a diaphragm pump includes exposing a sterilizing area of the diaphragm including and greater than a working area of the diaphragm to a working chamber of the pump. Sterilizing medium is introduced into the working chamber and over the sterilizing area of the diaphragm. Once the cleaning is concluded, a portion of the sterilizing area of the diaphragm is covered so as to expose only the working area of the diaphragm to the working chamber after sterilizing. The working area is exposed by displacing the base and head relative to each other in a first direction while maintaining them joined and while maintaining the diaphragm fixed to the base to expose the sterilizing area. A portion of the sterilized area is covered by displacing the base and head relative to each other in a direction opposite the first direction to clamp the diaphragm between the base and head and to cover a portion of the sterilizing area so as to expose only the working area of the diaphragm. Preferably, the sterilizing fluid is steam introduced through the inlet and maintained in the working chamber at a temperature, pressure and duration to obtain sterility of the working chamber and the sterilizing area of the diaphragm.

Although the present invention has been described and illustrated in detail, it is to be clearly understood that the same is by way of illustration and example only, and is not to be taken by way of limitation. The spirit and scope of the present invention are to be limited only by the terms of the appended claims.

FIG. *6a* is an enlarged view of a portion of the retaining ring of the second embodiment.

Figure 7:
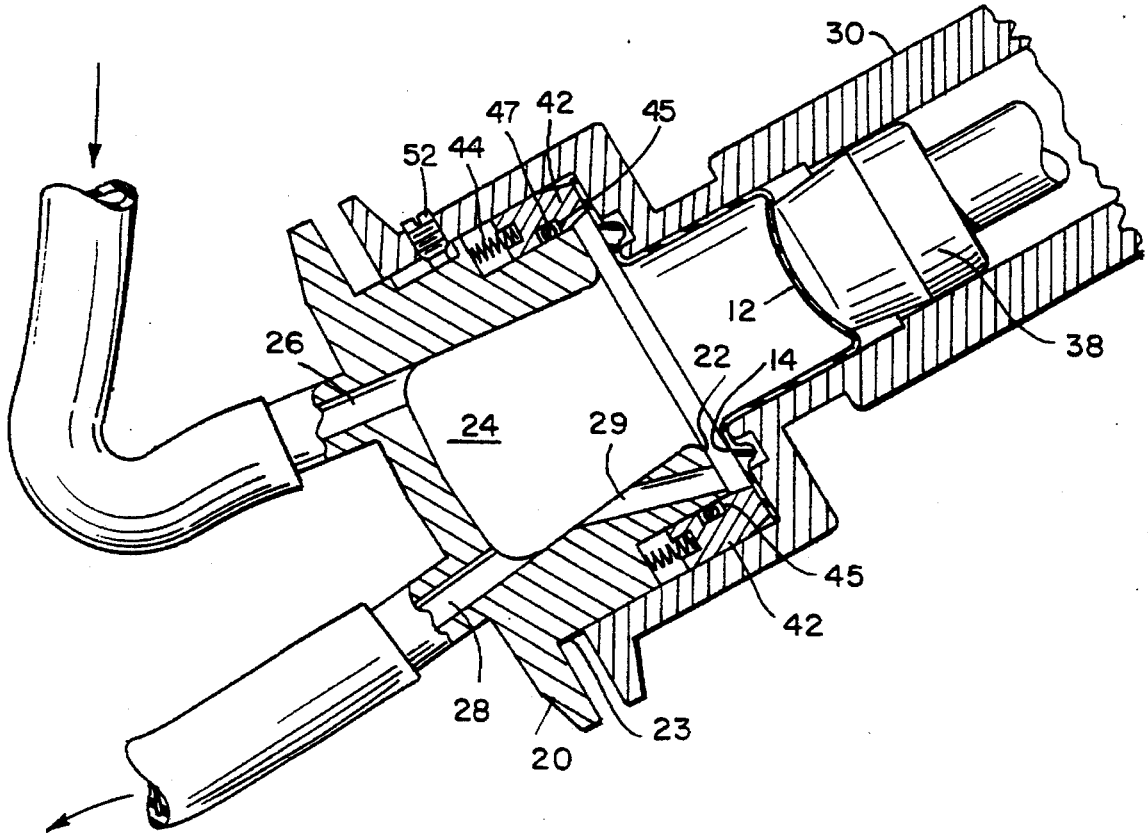

FIG. 7 is a cross sectional view of a third embodiment of a rolling diaphragm pump in its sterilize-in-place position according to the principles of the present invention.

DETAILED DESCRIPTION OF THE PREFERRED EMBODIMENTS

Figure 3:
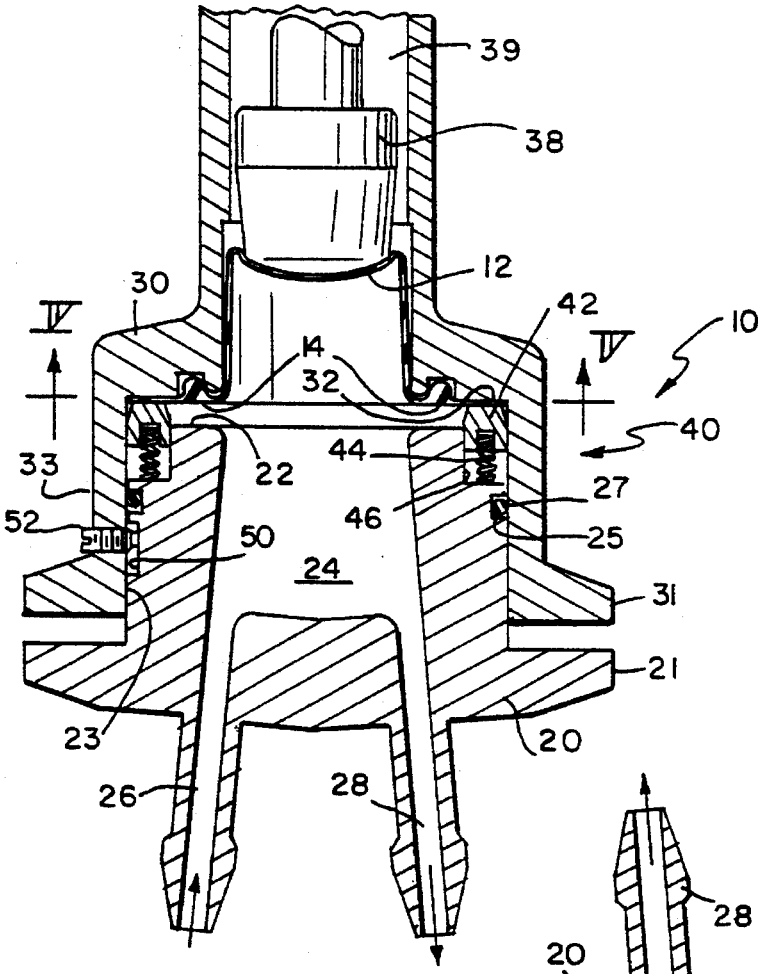
FIG. 3 is a cross sectional view of first embodiment of a rolling diaphragm pump in its sterilize-in-place position according to the principles of the present invention.
Figure 4:
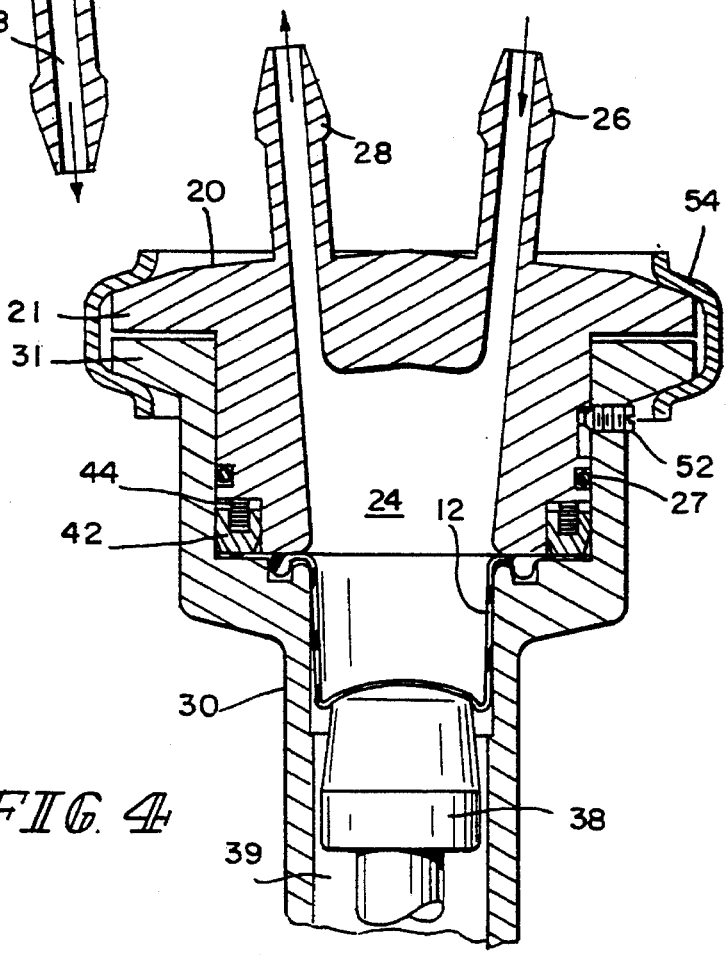
FIG. 4 is a cross sectional view of the first embodiment of the rolling diaphragm pump in its working position according to the principles of the present invention.

A rolling diaphragm filling unit or pump is illustrated in FIG. 3 and 4 including a head 20 and a base 30 having a diaphragm 12 there between to form a working chamber 24 in the head 20. The head includes an inlet port 26 and an outlet port 28. The surface 22 of the head 20 and 32 of the base 30 which provide the clamping forces on rim 14 of the diaphragm 12 are on the face and shoulder respectively of the head 20 and the base 30. The external flanges 21 and 31, as illustrated in FIG. 4, receive a ring clamp 54 in the working position of the head 20 and body 30. Lip 14 of the diaphragm 12 is clamped between surfaces 22 and 32. A wall 23 connects the clamping surface 22 to the exterior flange 21 and wall 33 connects the clamping surface 32 and flange 31 of the base 30. As is well known, the rolling diaphragm pump includes a piston 38 which is a driver in a vacuum chamber 39 of the base 30. The operation of the piston 38 and the vacuum chamber 39 is well known and it will not be described herein in detail. The clamping surface 32 of the base 30 includes a recess 36 to receive a bead 16 of the diaphragm 12 to limit lateral movement of the diaphragm 12.

The pump 10 of FIGS. 3 and 4 has been modified to allow exposure of a sterilizing area of the diaphragm to the working chamber 24 greater than the working area of the diaphragm exposed to the working chamber 24. This structure thereby achieves the advantages of autoclaving by establishing a comfort zone wherein flexing the diaphragm does not expose fluid in the working chamber 24 to unsterilized surfaces with the pumps elements in their working position. The objects to be achieved is to allow the head 20 to move relative to base 30 to expose the additional areas of the lip 14 while retaining the flange fixed to the base 30.

To achieve this objective, a retaining mechanism 40 is shown as including a retaining or compression ring 42 spring biased by spring 44 and received in a recess 46 in the surface 22 of the head 20 facing the base 30. A circumferential recess 25 in the head 20 receives a sealing ring 27. This maintains a seal of the working chamber 24 when the pump elements are in the sterilize-in-place in-place position of FIG. 3 or the working position of FIG. 4. The retaining mechanism 40 is between the seal 27 and the working chamber 24.

The limit of the working position and sterilize-in-place position or the relative positions of the head 20 to the base 30 is defined by a slot 50 in the periphery of wall 23 of the body. A pin 52 in wall 33 of the base extends into and cooperates with the slot 50 to define the limit of the sterilize-in-place position of FIG. 3 and the working position of FIG. 4. The pin 52 may be removed to allow total disassembly of the head 20 from the base 30 for repair and replacement.

Figure 1:
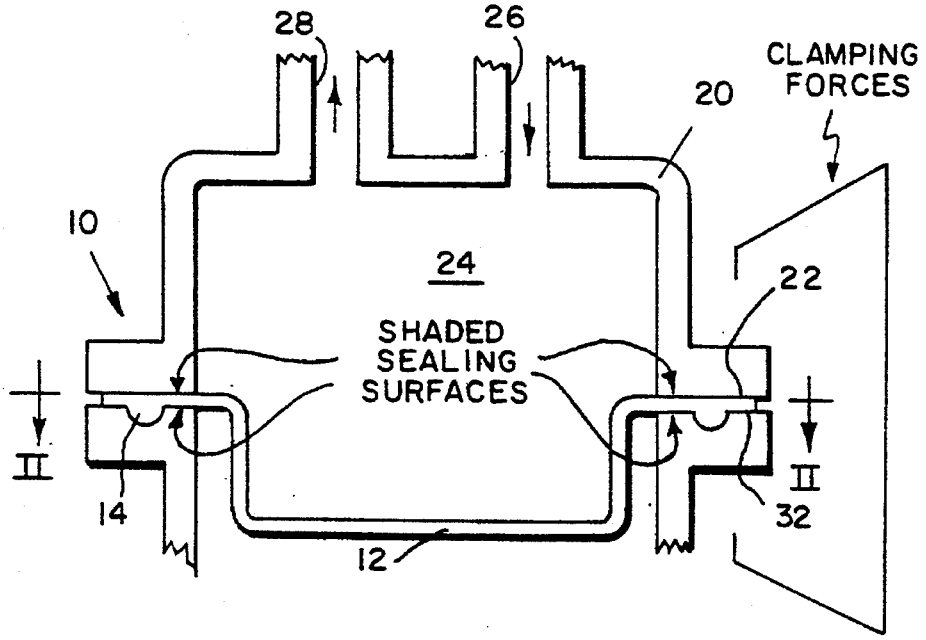
FIG. 1 is a schematic cross section representation of a rolling diaphragm pump of the prior art.

To sterilize-in-place the pump, the ring clamp 54 is removed and the head 20 is moved relative to the base 30 from its working position in FIG. 4 to its sterilize-in-place position in FIG. 3. This movement may be by the operator or spring 44 may be sufficiently strong to produce this movement. The relative movement of the head 20 relative to the base 30 exposes a cleaning area of the diaphragm 12 greater than the working area which is exposed to the working chamber 24 in the working position of FIG. 4. Also, the retaining structure 40 including retaining ring 42 and spring 44 and recess 46 are also exposed to the working chamber 24 in the sterilize-in-place position of FIG. 3. In the example shown, the working orientation of the pump in FIG. 1 and 4 is 180° from the sterilize-in-place orientation of FIG. 3 to allow draining of condensation through the inlet 26 and outlet 28.

Figure 2:
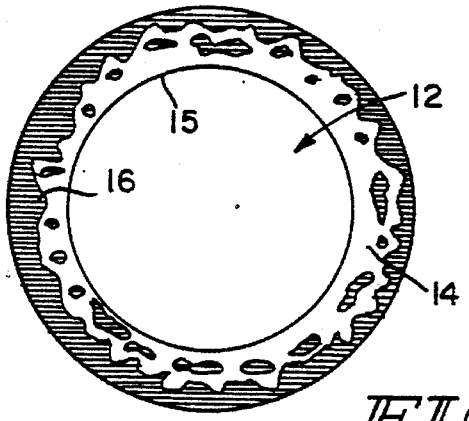
FIG. 2 is a cross sectional view taken along lines II—II of FIG. 1 showing possible sterile boundary configurations of the prior art device of FIG. 1.
Figure 5:
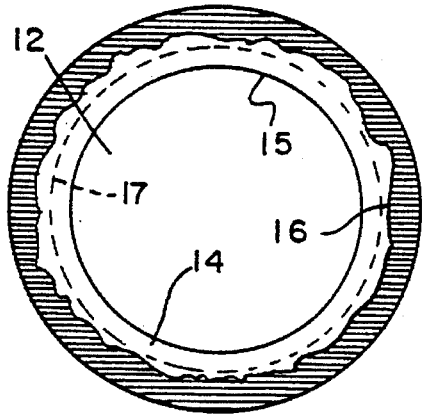
FIG. 5 is a cross sectional view taken along the V—V of FIG. 3 showing the sterile boundary or comfort zone according to the principles of the present invention.

A sterilizing media, for example, steam, is introduced into inlet 26 and is maintained in the chamber at the required temperature, pressure and duration to achieve sterility. For example, temperature in the range of 121 degrees Celsius to 125 degrees Celsius, at a pressure in the range of 15 P.S.I., for a duration in the range of 30 to 35 minutes will produce sterility in many cases. The sealing surfaces, which ultimately established the sterile boundary of the fluid cavity, are totally exposed to the sterilizing medium. Once the sterilization parameters have been validated and the steam supply has been discontinued, the head 20 is moved in the opposite direction back towards base 30 and clamping ring 54 is applied. The clamping ring 54 may be a tri-clover ring which tightens over the flanges 21 and 31 and thereby draws the head 20 into the base 30. Clamping surfaces 22 of the head and 32 of the base clamp the lip 14 of the diaphragm 12 thereto and cover a portion of the sterilized area so as to expose only the working area of the diaphragm 12. As illustrated in FIG. 5, the sterile boundary 16 on lip 14 is still irregular, but the sterile area is substantially greater in diameter than that of boundary 16 in FIG. 2 with no unsterile area between the retainer edge shown by a dotted line 17 and clamping edge 15. Thus, any expansion of the lip 14 into the working area during use will only expose sterile areas in the comfort zone between dotted line 17 and clamping edge 15.

The function of the retaining mechanism 40 is to hold the diaphragm 12 down so as to maintain the fluid working chamber 24 as a discrete pressurized chamber separate from the vacuum chamber 39 in the base 30 when the pump elements are in the sterilize-in-place position of FIG. 3. The sealing ring 27 defines the boundary of the working chamber in the sterilize-in-place position of the elements. Although the retaining mechanism 40 including a portion of the retaining ring 42 and the spring 44 are sterilized during the sterilization process, once the surfaces 22 and 32 are brought together in the working position, the elements of the retaining mechanism 40 are external to the fluid working chamber 24.

Figure 6:
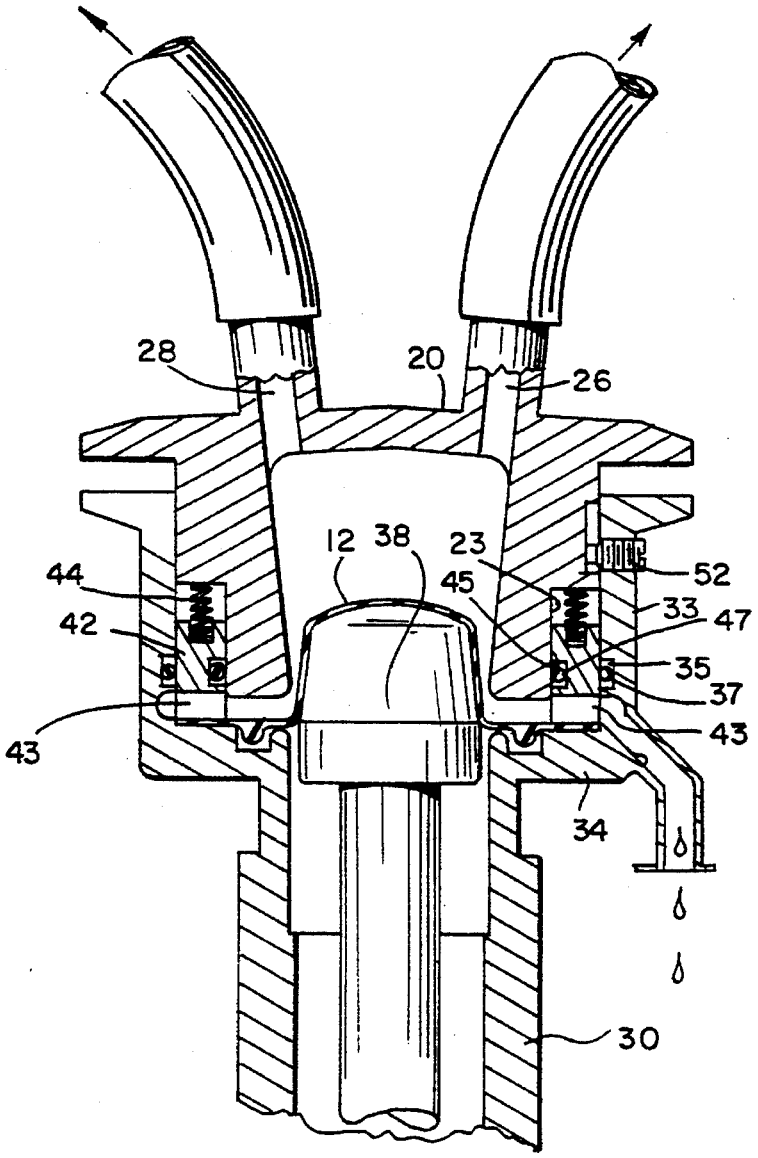
FIG. 6 is a cross sectional view of a second embodiment of the rolling diaphragm pump in its sterilize-in-place position according to the principles of the present invention.
Figure 6A:
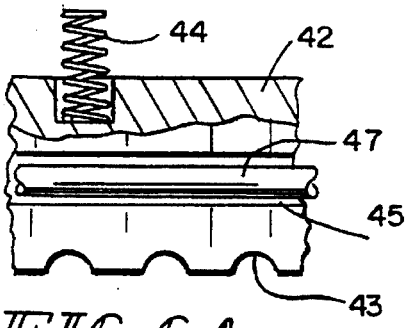

FIG. 6 and **6*a* illustrate a second embodiment of the present invention which allows sterilizing-in-place of the rolling diaphragm pump in the same orientation as its working orientation. To allow the condensation to drain, the compression ring 42 includes a plurality of notches 43 which align with a circumferal recess 34 in the base 30. A drain is connected to the circumferal recess 34. Another variant between the embodiments of FIG. 6 than that of FIGS. 3 and 4, is that the compression ring 42 includes a sealing ring 47 in a circumferal recess 45 facing wall 23 of the head 20. A second sealing ring 37 is in circumferential recess 35 of wall 33 of the base 30. This isolates the spring 44 of the retainer from the working chamber 24 during the sterilization process. The sealing rings 37 and 47 provide a seal between the head 20 and the body 30 in combination with the seal provided by the flange 14 of the diaphragm 12** in the working and sterilize-in-place positions of the elements.

As another distinction between the embodiment of FIG. 6 and that of FIG. 3 and 4, is that the pump is stopped with its piston 38 extended at the top of the discharge stroke. This allows the condensation to flow down the dome of the diaphragm 12 through the notches 43 and circumferal recess 34 to the drain which is connected to a steam trap. In this case, the steam enters through the outlet 28 and exits through inlet 26 or vice versa.

FIG. 7 illustrates a third embodiment of a sterilization-in-place rolling diaphragm pump in its sterilization position. As in the embodiment of FIG. 6, the retaining ring 42 includes the sealing ring 47. The sealing ring 37 in the base 30 is not needed since the circumferal recess 34 is also not in the body 30. Thus, it is not needed to isolate the spring 44 and the majority of the surface of the retaining ring 42 from the working chamber 24 during sterilization. As an alternative method to providing a drain, a passage 29 is provided in the wall 23 of the head 20 connecting top clamping surface 22 with the working chamber 24. This prevents condensation from building up in the small pocket between the clamping surfaces 22 and 32. During sterilization, the pump is rotated from its vertical orientation of FIG. 1 and 4, 120° to the angular orientation of FIG. 7. As in FIG. 4, the piston 38 and diaphragm 12 are at the end of the intake stroke. The same is provided through inlet 26 and exits out outlet 28.

Although the spring loaded retaining ring 42 is shown as the retaining mechanism, other retaining mechanisms may include elastomer rings and Belleville washers to maintain pressure upon the diaphragm. Also, the different relative positions of the pump head and pump body may be established and maintained by means of pneumatic or electric motor actuation. As an alternative, the bead 16 of the diaphragm 12 may be mounted in a recess in a mounting surface 22 of the head and the retaining mechanism 40 would be positioned in a recess in the mating surface 32 of the base 30. Also, instead of a recess 50 and pin 52, in combination with ring clamp 54, a threaded clamp collar may be used to define the working position in the sterilize-in-place position of the elements.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A filling unit for transporting a material from a source to a container comprising:

a housing including a base housing element and a head housing element mounted on said base in a working position and displaced from said base in a sterilize-in-place position;

a flexible diaphragm positioned between and clamped by said base and head to define between said diaphragm and said head a working chamber in said housing with said housing elements in said working position;

drive means for reciprocating said diaphragm;

port means on said head for providing material intake and discharge ports for said working chamber; and means for retaining said diaphragm fixed to said base with said head displaced from said base in said sterilize-in-place position of said housing element.

2. A filling unit according to claim 1 wherein said housing elements in said working position expose a first area of said diaphragm to said working chamber and in said sterilize-in-place position expose a second area greater than and including said first area.

3. A filling unit according to claim 2 wherein said head delineates said first area and said retaining means delineates said second area.

4. A filling unit according to claim 1 including means for sealing said head to said base in said working and sterilize-in-place positions.

5. A filling unit according to claim 4 wherein said sealing means includes a first seal located between said retaining means and said head.

6. A filling unit according to claim 5 including sealing means includes a second seal located between said retaining means and said body.

7. A filling unit according to claim 1 wherein said retaining means is located in a recess of said head facing said base.

8. A filling unit according to claim 1 including means interconnecting said base and head for defining said working and sterilize-in-place positions.

9. A filling unit for transporting a material from a source to a container comprising:

a housing including a base housing element and a head housing element mounted on said base in a working position and displaced from said base in a sterilize-in-place position;

a flexible diaphragm positioned between and clamped by said base and head to define between said diaphragm and said head a working chamber in said housing with said housing elements in said working position;

drive means for reciprocating said diaphragm;

port means on said head for providing material intake and discharge ports for said working chamber;

means for retaining said diaphragm fixed to said base with said housing elements in said sterilize-in-place position; and interconnecting means, including a peripheral slot in said head and a pin in said base extending into said peripheral slot, for defining said working and sterilize-in-place positions.

10. A filling unit according to claim 9 wherein said peripheral slot and said pin define said sterilize-in-place position.

11. A filling unit according to claim 9 wherein said interconnecting means includes clamping means for clamping said base and head together in and defining said working position.

12. A filling unit according to claim 9 wherein said pin is removable to allow disassembly of said housing elements.

13. A filling unit for transporting a material from a source to a container comprising:

a housing including a base housing element and a head housing element mounted on said base in a working position and displaced from said base in a sterilize-in-place position;

a flexible diaphragm positioned between and clamped by said base and head to define between said diaphragm and said head a working chamber in said housing with said housing elements in said working position;

drive means for reciprocating said diaphragm;

port means on said head for providing material intake and discharge ports for said working chamber; and means between said base and head and including a ring and a spring for biasing said ring towards said base for retaining said diaphragm fixed to said base with said housing elements in said sterilize-in-place position.

14. A filling unit for transporting a material from a source to a container comprising:

a housing including a base housing element and a head housing element mounted on said base in a working position and displaced from said base in a sterilize-in-place position;

a flexible rolling diaphragm positioned between and clamped by said base and head to define between said diaphragm and said head a working chamber in said housing with said housing elements in said working position;

drive means for reciprocating said diaphragm;

port means on said head for providing material intake and discharge ports for said working chamber; and means, located exterior to said working chamber in said working position and at least a portion being exposed to said working chamber in said sterilize-in-place position, for retaining said diaphragm fixed to said base with said housing elements in said sterilize-in-place position.

15. A filling unit for transporting a material from a source to a container comprising:

a housing including a base housing element and a head housing element mounted on said base in a working position and displaced from said base in a sterilize-in-place position;

a flexible diaphragm positioned between and clamped by said base and head to define between said diaphragm and said head a working chamber in said housing with said housing elements in said working position;

a drain in said head exterior to said working chamber;

drive means for reciprocating said diaphragm;

port means on said head for providing material intake and discharge ports for said working chamber; and means for retaining said diaphragm fixed to said base with said housing elements in said sterilize-in-place position, and said retaining means including notches connecting the drain to the working chamber with said housing elements in said sterilization-in-place position.

16. A filling unit for transporting a material from a source to a container comprising:

a housing including a base housing element and a head housing element mounted on said base in a working position and displaced from said base in a sterilize-in-place position;

a flexible diaphragm positioned between and clamped by said base and head to define between said diaphragm and said head a working chamber in said housing with said housing elements in said working position;

a drain in said head exterior to said working chamber;

drive means for reciprocating said diaphragm;

port means on said head for providing material intake and discharge ports for said working chamber;

means for retaining said diaphragm fixed to said base with said housing elements in said sterilize-in-place position; and a passage in said head connecting a portion of said working chamber, created when said housing elements are in said sterilization-in-place position, to said port means.

* * * * *